US008757612B2

(12) United States Patent
Tsai

(10) Patent No.: US 8,757,612 B2
(45) Date of Patent: Jun. 24, 2014

(54) PAPER FEEDING MECHANISM

(71) Applicant: Hon Hai Precision Industry Co., Ltd., New Taipei (TW)

(72) Inventor: Ping-Fang Tsai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/891,155

(22) Filed: May 9, 2013

(65) Prior Publication Data

US 2013/0334765 A1 Dec. 19, 2013

(30) Foreign Application Priority Data

Jun. 14, 2012 (TW) ..... 101121418 A

(51) Int. Cl.
*B65H 3/52* (2006.01)
*B65H 3/34* (2006.01)

(52) U.S. Cl.
USPC ..... 271/121; 271/167

(58) Field of Classification Search
USPC ..... 271/121, 167
See application file for complete search history.

(56) References Cited

U.S. PATENT DOCUMENTS

| | | | | |
|---|---|---|---|---|
| 5,971,390 | A * | 10/1999 | Caspar et al. | 271/121 |
| 7,000,916 | B2 * | 2/2006 | Asada et al. | 271/121 |
| 7,014,186 | B2 * | 3/2006 | Shiohara et al. | 271/121 |
| 7,108,257 | B2 * | 9/2006 | Shiohara et al. | 271/104 |
| 7,172,192 | B2 * | 2/2007 | Mitsuhashi | 271/121 |
| 7,770,885 | B2 * | 8/2010 | Klein | 271/121 |
| 7,852,526 | B2 * | 12/2010 | Mo et al. | 358/498 |
| 7,959,148 | B2 * | 6/2011 | Alsip et al. | 271/121 |
| 8,454,007 | B1 * | 6/2013 | Li et al. | 271/121 |
| 2004/0012140 | A1 * | 1/2004 | Asada et al. | 271/121 |
| 2004/0017039 | A1 * | 1/2004 | Asada et al. | 271/121 |

* cited by examiner

*Primary Examiner* — Kaitlin Joerger
(74) *Attorney, Agent, or Firm* — Novak Druce Connolly Bove + Quigg LLP

(57) ABSTRACT

A paper feeding mechanism includes a paper cassette, a feeding roller, a baffle, and a paper separating apparatus. The paper cassette stores stacks of paper. The feeding roller pulls a sheet of paper from the paper cassette and feeds the sheet of paper into a paper transport path. The baffle is located at a side of the paper cassette. The paper separating apparatus is mounted to the baffle and prevents more than one sheet of paper from being fed into the paper transport path at a time.

16 Claims, 5 Drawing Sheets

PAPER FEEDING MECHANISM

REFERENCE TO RELATED APPLICATIONS

This application claims all benefits accruing under 35 U.S.C. §119 from Taiwan Patent Application No. 101121418, filed on Jun. 14, 2012 in the Taiwan Intellectual Property Office, the contents of the Taiwan Application are hereby incorporated by reference.

BACKGROUND

1. Technical Field

The present disclosure generally relates to image formation devices, and particularly relates to a paper feeding mechanism of a printer.

2. Description of Related Art

A printer typically includes a paper cassette for storing stacks of paper. A feeding roller pulls paper from the paper cassette and feeds the paper into a paper transport path. However, the feeding roller can sometimes pull more than one sheet of paper from the paper cassette at a time, resulting in paper jams.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
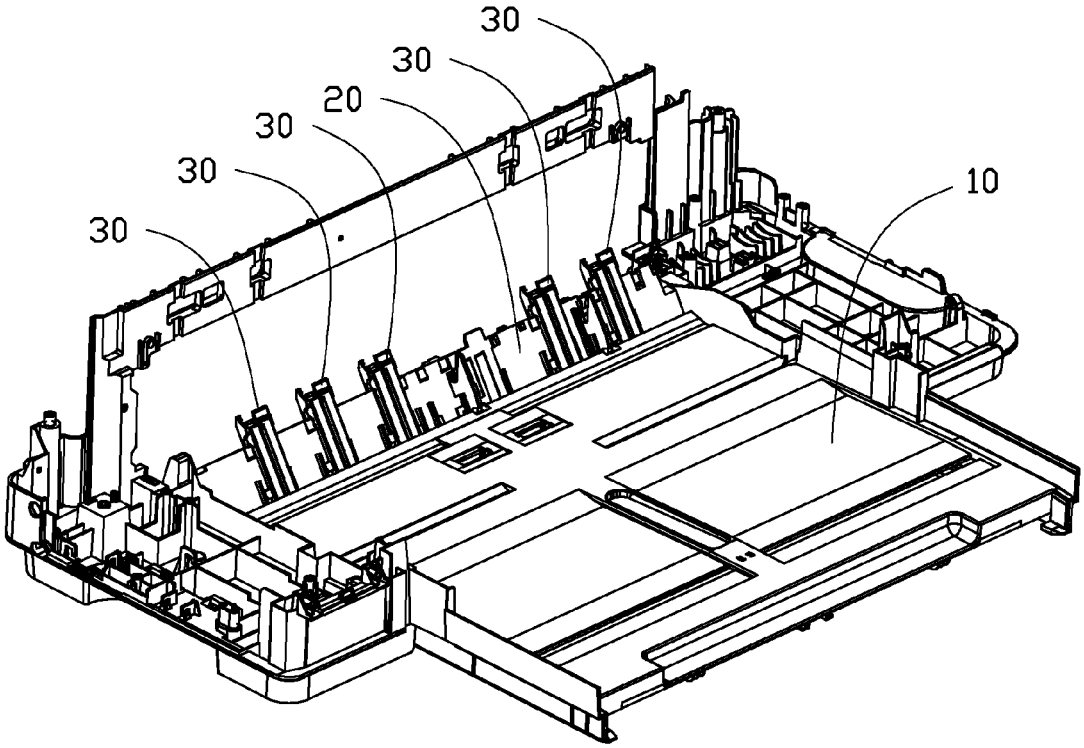
FIG. 1 is an isometric view of an embodiment of a paper feeding mechanism of a printer.
Figure 2:
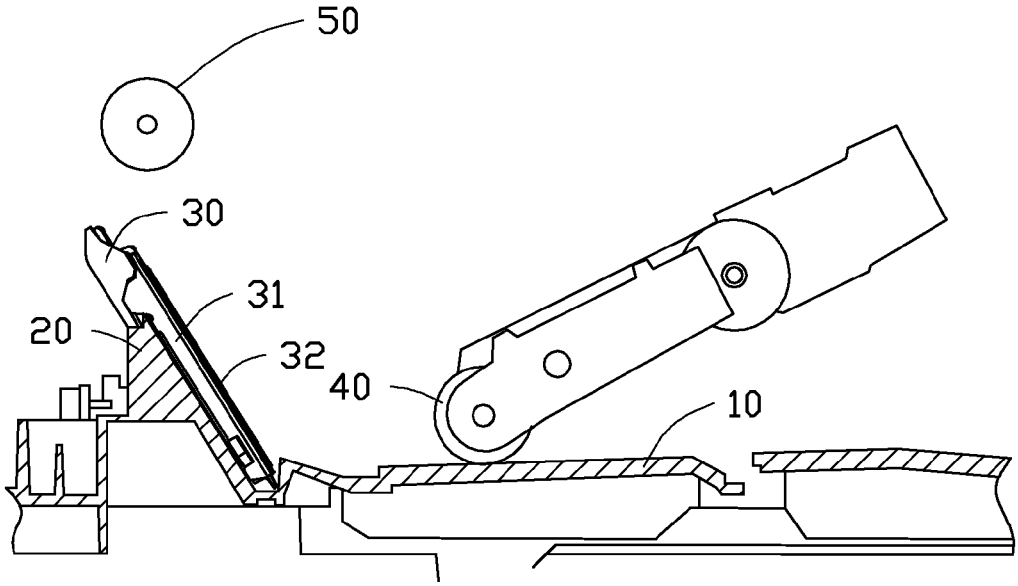
FIG. 2 is a cross-sectional view of the paper feeding mechanism of FIG. 1.

FIGS. 1 and 2 show an embodiment of a paper feeding mechanism of a printer. The paper feeding mechanism includes a paper cassette 10, a baffle 20, at least one paper separating member 30, and a feeding roller 40. The paper cassette 10 can store stacks of paper. The paper feeding mechanism further includes a conveying roller 50 located above the baffle 20.

The baffle 20 is located at a side of the paper cassette 10. The baffle 20 is oblique relative to a bottom plate of the paper cassette 10. A sheet of paper can be pulled from the paper cassette 10 by the feeding roller 40, moved towards and across the baffle 20, and finally fed into a paper transport path by the conveying roller 50.

The feeding roller 40 is located above the paper cassette 10. The feeding roller 40 is movable relative to the paper cassette 10. FIG. 2 shows that when the feeding roller 40 is instructed to feed a sheet of paper from the paper cassette 10, the feeding roller 40 moves towards the bottom plate of the paper cassette 10 until the feeding roller 40 contacts the top sheet of paper stored in the paper cassette 10. The feeding roller 40 then rotates to produce a friction force to drive the top sheet of paper to move towards the baffle 20.

Figure 3:
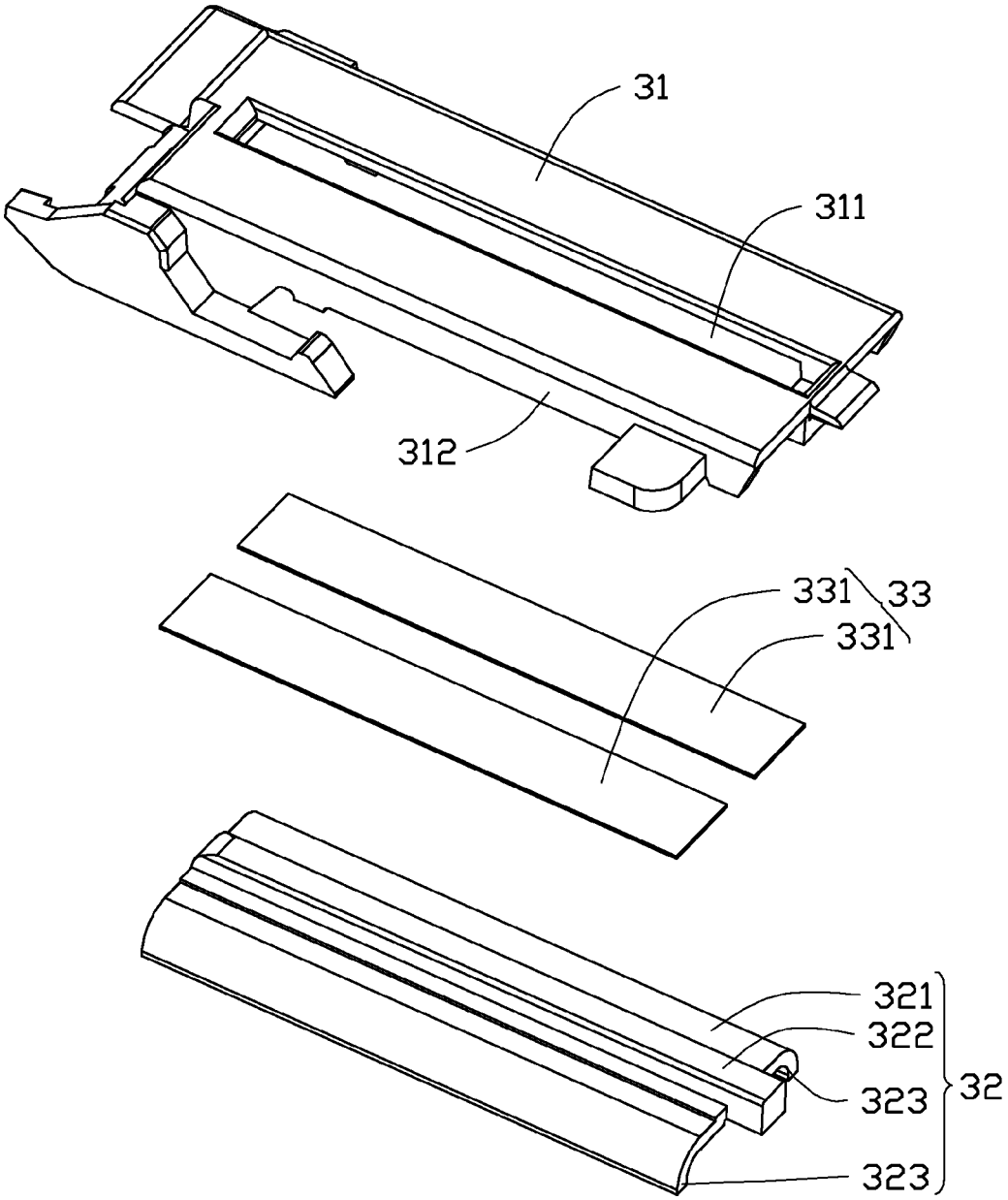
FIG. 3 is an exploded, isometric view of a paper separating apparatus of the paper feeding mechanism of FIG. 1.
Figure 4:
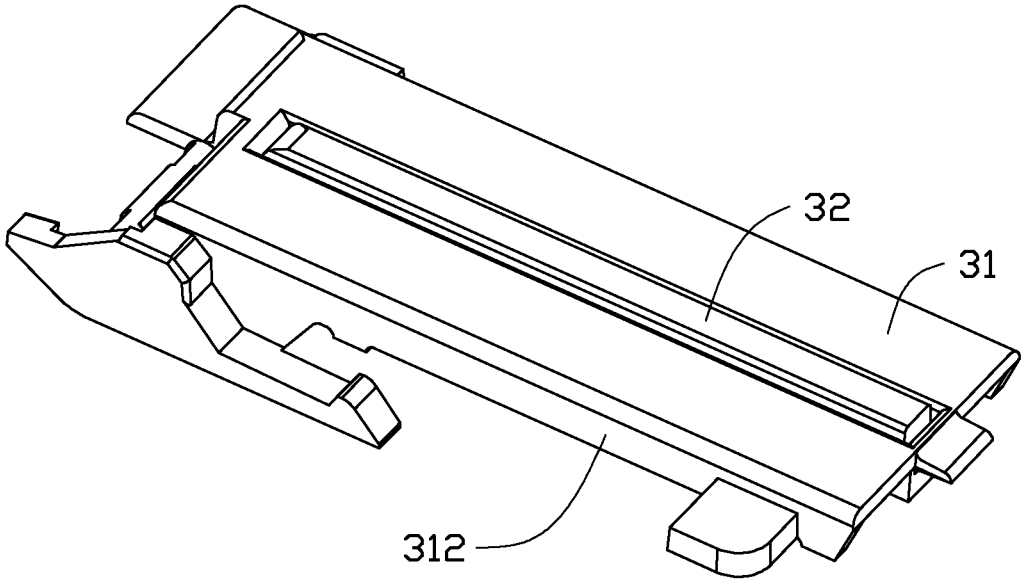
FIG. 4 is an assembled view of the paper separating apparatus of FIG. 3.
Figure 5:
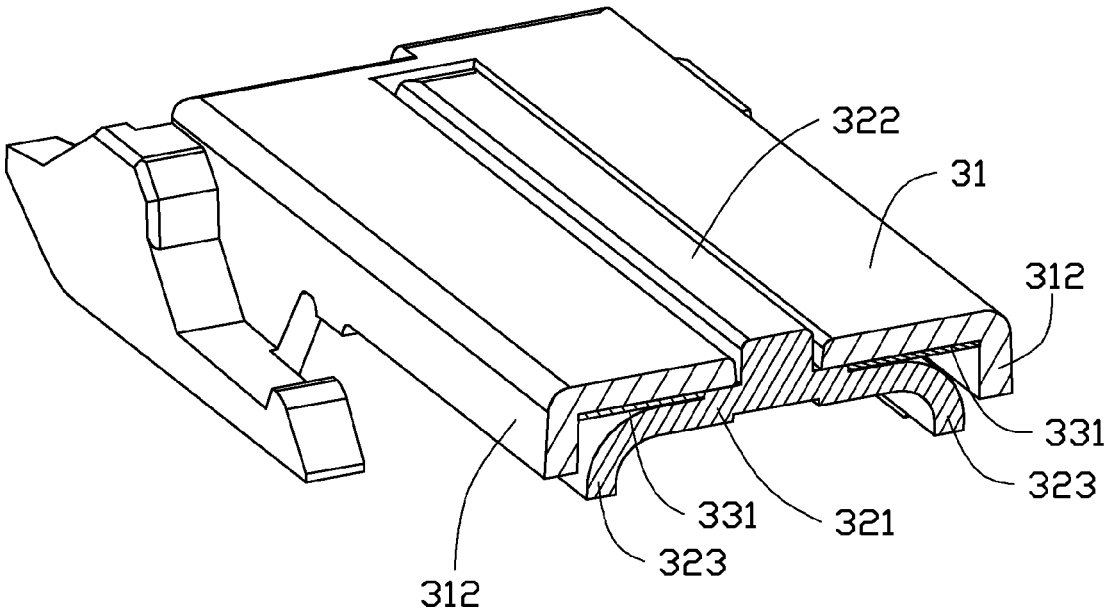
FIG. 5 is a cross-sectional view taken along a line V-V of the paper separating apparatus of FIG. 4.

The paper separating apparatus 30 is mounted to the baffle 20. The paper separating apparatus 30 can prevent more than one sheet of paper from being fed into the paper transport path at a time. FIGS. 3-5 show that the paper separating apparatus 30 includes a securing plate 31 and a rubber pad 32. The securing plate 31 is attached to an upper surface of the baffle 20. The rubber pad 32 is located between and sandwiched by the securing plate 31 and the upper surface of the baffle 20. An outer surface of the securing plate 31 is smooth so that the paper separating apparatus 30 can facilitate movement of the sheet of paper passing across the separating apparatus 30. In one embodiment, the securing plate 31 is made from plastic material.

The securing plate 31 defines an opening 311. The opening 311 is elongated an extending direction along the paper transport path. Two flanges 312 are bent from two opposite edges of the securing plate 311 and abut against the upper surface of the baffle 20. Thus, the paper separating apparatus 30 together with the baffle 20 form a receiving space. In one embodiment, the opening 311 is defined at a middle portion of the securing plate 31.

The rubber pad 32 is received in the receiving space between the paper separating apparatus 30 and the baffle 20. The rubber pad 32 includes a main body 321 and a rib 322. The rib 322 protrudes from an outer side of the main body 321 and extends out of the opening 311 of the securing plate 31 of the paper separating apparatus 30. The rib 322 is elongated an extending direction along the paper transport path. Two wings 323 are bent from two opposite edges of the rubber pad 32 and contact the upper surface of the baffle 20.

Because the paper sheets are stacked in the paper cassette 10, the feeding roller 40 may sometimes pull more than one sheet of paper from the paper cassette 10. If more than one sheet of paper is picked up and transferred to the baffle 20, the bottom sheet of paper will contact the rib 322 of the rubber pad 32. The friction force produced between the rib 322 and the bottom sheet of paper prevents the bottom sheet of paper from moving. The other sheets of paper will not be affected by either the friction force produced by the rib 322 or the friction force produced by the feeding roller 40. Thus, only the top sheet of paper can be fed into the paper transport path.

In some embodiments, the paper separating apparatus 30 further includes an isolating medium 33. The isolating medium 33 is located between and sandwiched by the securing plate 31 and the rubber pad 32. The isolating medium 33 includes two isolating pieces 331. The two isolating pieces 331 are located at two opposite sides of the rib 322 of the rubber pad 32. The isolating medium 33 can prevent the rubber pad 32 from sticking to the securing plate 31. In one embodiment, each of the two isolating pieces 331 is a polyester film.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A paper feeding mechanism, comprising:

a paper cassette adapted to store stacks of paper, a feeding roller adapted to pull a sheet of paper from the paper cassette and feed the sheet of paper into a paper transport path;

a baffle located at a side of the paper cassette; and a paper separating apparatus mounted to the baffle and adapted to prevent more than one sheet of paper from being fed into the paper transport path at a time;

wherein the paper separating apparatus comprises a securing plate attached to an upper surface of the baffle, a rubber pad located between and sandwiched by the securing plate and the upper surface of the baffle, and an isolating medium located between and sandwiched by the securing plate and the rubber pad.

2. The paper feeding mechanism of claim 1, wherein the securing plate defines an opening, the rubber pad comprises a main body and a rib protruding from the main body and extending out of the opening of the securing plate.

3. The paper feeding mechanism of claim 2, wherein the opening and the rib are elongated an extending direction along the paper transport path.

4. The paper feeding mechanism of claim 2, wherein the opening is defined at a middle portion of the securing plate.

5. The paper feeding mechanism of claim 1, wherein the securing plate is made from plastic material.

6. The paper feeding mechanism of claim 1, wherein two flanges are bent from two opposite edges of the securing plate and abut against the upper surface of the baffle.

7. The paper feeding mechanism of claim 6, wherein two wings are bent from two opposite edges of the rubber pad and contact with the upper surface of the baffle.

8. The paper feeding mechanism of claim 7, wherein the isolating medium comprises two isolating pieces located at two opposite sides of the rib of the rubber pad.

9. The paper feeding mechanism of claim 8, wherein each of the two isolating pieces is a polyester film.

10. A paper feeding mechanism, comprising:

a paper cassette adapted to store stacks of paper, a baffle located at a side of the paper cassette;

a feeding roller adapted to pull a sheet of paper from the paper cassette and transfer the sheet of paper to the baffle; and a paper separating apparatus mounted to an upper surface of the baffle, wherein the paper separating apparatus comprises a securing plate attached to an upper surface of the baffle and a rubber pad located between and sandwiched by the securing plate and the upper surface of the baffle, the securing plate defines an opening, and the rubber pad comprises a rib extending out of the opening;

wherein the opening and the rib are elongated an extending direction along the paper transport path, the paper separating apparatus further comprises an isolating medium located between and sandwiched by the securing plate and the rubber pad.

11. The paper feeding mechanism of claim 10, wherein the opening is defined at a middle portion of the securing plate.

12. The paper feeding mechanism of claim 10, wherein the isolating medium comprises two isolating pieces located at two opposite sides of the rib of the rubber pad.

13. The paper feeding mechanism of claim 12, wherein each of the two isolating pieces is a polyester film.

14. The paper feeding mechanism of claim 10, wherein the securing plate is made from plastic material.

15. The paper feeding mechanism of claim 10, wherein two flanges are bent from two opposite edges of the securing plate and abut against the upper surface of the baffle.

16. The paper feeding mechanism of claim 10, wherein two wings are bent from two opposite edges of the rubber pad and contact with the upper surface of the baffle.

* * * * *